US007212755B2

(12) United States Patent
Onishi

(10) Patent No.: US 7,212,755 B2
(45) Date of Patent: May 1, 2007

(54) IMAGE FORMING APPARATUS

(75) Inventor: Akihito Onishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 108 days.

(21) Appl. No.: 11/008,156

(22) Filed: Dec. 10, 2004

(65) Prior Publication Data

US 2005/0129421 A1 Jun. 16, 2005

(30) Foreign Application Priority Data

Dec. 12, 2003 (JP) ..... 2003-414188

(51) Int. Cl.
*G03G 15/00* (2006.01)

(52) U.S. Cl. ..... 399/34

(58) Field of Classification Search ..... 399/38
See application file for complete search history.

(56) References Cited

U.S. PATENT DOCUMENTS 5,926,677 A * 7/1999 Ochiai et al. ..... 399/277

FOREIGN PATENT DOCUMENTS

JP 07-056491 3/1995

* cited by examiner

*Primary Examiner*—Vincent Q. Nguyen
(74) *Attorney, Agent, or Firm*—Rabin & Berdo, PC

(57) ABSTRACT

A drum idle rotation is executed by the timing before printing on the basis of the number of drum idle rotating times selected by the operator, or the number of drum idle rotating times is set in accordance with a print image kind or a drum count value and the drum idle rotation is performed by the timing before printing on the basis of the set value. The number of drum idle rotating times by the timing before printing is corrected by a print density or an apparatus environment. Defective exposure or generation of a lateral stripe due to oligomer which is generated in the portion where a developing roller or a photosensitive drum is come into contact is prevented.

19 Claims, 13 Drawing Sheets

*Fig.5*

| | NO DRUM IDLE ROTATION | DRUM IDLE ROTATION | | |
|---|---|---|---|---|
| QUALITY LEVEL | LEVEL 0 | LEVEL 1 | LEVEL 2 | LEVEL 3 |
| THE NUMBER OF DRUM IDLE ROTATING TIMES (Dd) | 0 | 3 | 6 | 10 |

*Fig.6*

| PRINT IMAGE KIND | TEXT | GRAPHICS | DTP | PHOTOGRAPH |
|---|---|---|---|---|
| THE NUMBER OF DRUM IDLE ROTATING TIMES (Dd) | 0 | 3 | 6 | 10 |

| DRUM COUNT D0 | 0~0.5K | 0.5K~3K | 3K~10K | 10K~15K | 15K~ |
|---|---|---|---|---|---|
| THE NUMBER OF DRUM IDLE ROTATING TIMES (Dd) | 6 | 12 | 6 | 3 | 0 |

| PRINT DENSITY Pd | ≦2.5% | 2.5%~5% | 5%~15% | ≧15% |
|---|---|---|---|---|
| CORRECTION VALUE ΔDd | 3 | 2 | 1 | 0 |

Fig.14

| PRINT DENSITY Pd | ≦2.5% | 2.5%~5% | 5%~15% | ≧15% |
|---|---|---|---|---|
| THE NUMBER OF DRUM IDLE ROTATING TIMES (Dd) | 3 | 2 | 1 | 0 |

15K~

| PRINT DENSITY Pd | ≦2.5% | 2.5%~5% | 5%~15% | ≧15% |
|---|---|---|---|---|
| THE NUMBER OF DRUM IDLE ROTATING TIMES (Dd) | 9 | 8 | 7 | 6 |

10K~15K

3K~10K 0.5K~3K

0~0.5K

Fig.16

| ABSOLUTE HUMIDITY ($g/m^3$) | 3~7 | 7~11 | 11~15 |
|---|---|---|---|
| CORRECTION VALUE $\Delta Dd'$ | 0 | 1 | 2 |

IMAGE FORMING APPARATUS

BACKGROUND OF THE INVENTION

1. Field of the Invention

The invention relates to an image forming apparatus such as an electrophotographic printer having means for certainly preventing print dirt even if the apparatus is in a stationary state for a predetermined period.

2. Related Background Art

Generally, in an image forming apparatus such as an electrophotographic printer or the like, a photosensitive drum comes into contact with a charging roller and is, then, charged, an electrostatic latent image is written onto the photosensitive drum by an exposing unit, a toner image is formed onto the electrostatic latent image by a developing apparatus comprising a developing roller, a developing blade, and the like, and the toner image is transferred onto a print medium by a transfer apparatus comprising a transfer roller and a transfer belt, thereby printing.

The toner remaining on the photosensitive drum after the transfer is collected by pushing a cleaning roller or a cleaning blade of a cleaning apparatus onto the rotating photosensitive drum (for example, refer to JP-A-07-56491).

Most of the image forming apparatuses such as an electrophotographic printer and the like use a contact type developing system in which a developing roller constructed by forming a rubber elastic layer onto a conductive shaft comes into contact with a photosensitive drum by a predetermined pressing force and toner is developed.

However, in the conventional image forming apparatuses, there is such a problem that in a portion where the developing roller comes into contact with the photosensitive drum (hereinbelow, such a portion is referred to as a nip portion), since they are always in the contact state, if they are left for a long time without executing printing, low molecular components (hereinafter, referred to as "oligomer") precipitated from a rubber material of the developing roller are deposited onto the photosensitive drum, so that no dot can be formed due to defective exposure in a halftone image in a 1-by-1 mode or a 2-by-2 mode in the first printing. There is also such a problem that since a lateral stripe is formed, quality of the print image deteriorates (hereinafter, such a state is referred to as an "oligomer line").

SUMMARY OF THE INVENTION

It is, therefore, an object of the invention to provide an image forming apparatus having means for certainly preventing print dirt even if the apparatus is in a stationary state for a predetermined period.

According to the present invention, there is provided an image forming apparatus comprising:

an electrostatic latent image-bearing body;

an image forming member provided for the electrostatic latent image-bearing body in a contact state;

setting section which sets a set value for rotating the electrostatic latent image-bearing body by a predetermined amount before an electrostatic latent image is formed onto the electrostatic latent image-bearing body; and a control unit for rotating the electrostatic latent image-bearing body on the basis of the set value before the electrostatic latent image is formed onto the electrostatic latent image-bearing body.

In the apparatus, the image forming member is a developing member which makes a developer stick to the electrostatic latent image on the electrostatic latent image-bearing body.

The apparatus may further comprise a voltage providing section for providing the developing member with a voltage, and when the electrostatic latent image-bearing body rotated in a predetermined quantity, the voltage providing section controls the voltage provided to the developing member.

Also, the apparatus may further comprise a voltage providing section, and in the apparatus, the image forming member includes an electrifying member for electrifying the electrostatic latent image-bearing body; a developing member for making a developer stick to the electrostatic latent image on the electrostatic latent image-bearing body; and a transferring member for transferring the developer on the electrostatic latent image-bearing body onto printing medium, the voltage providing section provides respectively the electrifying member, the developing member and the transferring member with voltages, and when the electrostatic latent image-bearing body rotated in a predetermined quantity, the voltage providing section controls the voltages provided to the electrifying member, the developing member and the transferring member.

Also, in the apparatus, the image forming member may further include a removing member for removing residual developer which remains on the electrostatic latent image-bearing body after being transferred.

Also, the apparatus, the setting section sets value on the basis of the kinds of print images. In the case, when the kind density of the printing images is higher, the rotation number of the electrostatic latent image-bearing body is more set.

Also, the setting section sets value on the basis of the rotation number of the electrostatic latent image-bearing body. In the case, when the rotation number of the electrostatic latent image-bearing body is more, the predetermined amount is less set.

Also, the setting section sets the set value on the basis of a print density. In the case, when the printing density of the printing images is lower, the predetermined amount is more set.

Also, The apparatus may further comprise a detecting unit which obtains temperature/humidity information, and wherein the setting section sets the set value on the basis of a detection result of the detecting unit. In the case, when an absolute humidity which is calculated on the basis of the result of the detecting unit is higher, the setting section sets much the predetermined amount.

According to the invention, since the image forming apparatus is controlled so as to perform the idle rotation of the drum by the timing before printing in accordance with settings of the operator or on the basis of print set values, environment information, or the like which exercises an influence on the generation of the oligomer line, printing of high quality can be performed.

The above and other objects and features of the present invention will become apparent from the following detailed description and the appended claims with reference to the accompanying drawings.

BRIEF DESCRIPTION OF THE DRAWINGS

FIG. 5 is a table of the number (Dd) of idle rotating times of a drum in the first embodiment;

FIG. 6 is a table of the number (Dd) of idle rotating times of a drum in the second embodiment;

FIG. 14 is a table of the number (Dd) of idle rotating times of a drum in the fourth embodiment;

FIG. 16 is a correction table according to the environment in the fifth embodiment.

DETAILED DESCRIPTION OF THE PREFERRED EMBODIMENTS

Figure 1:
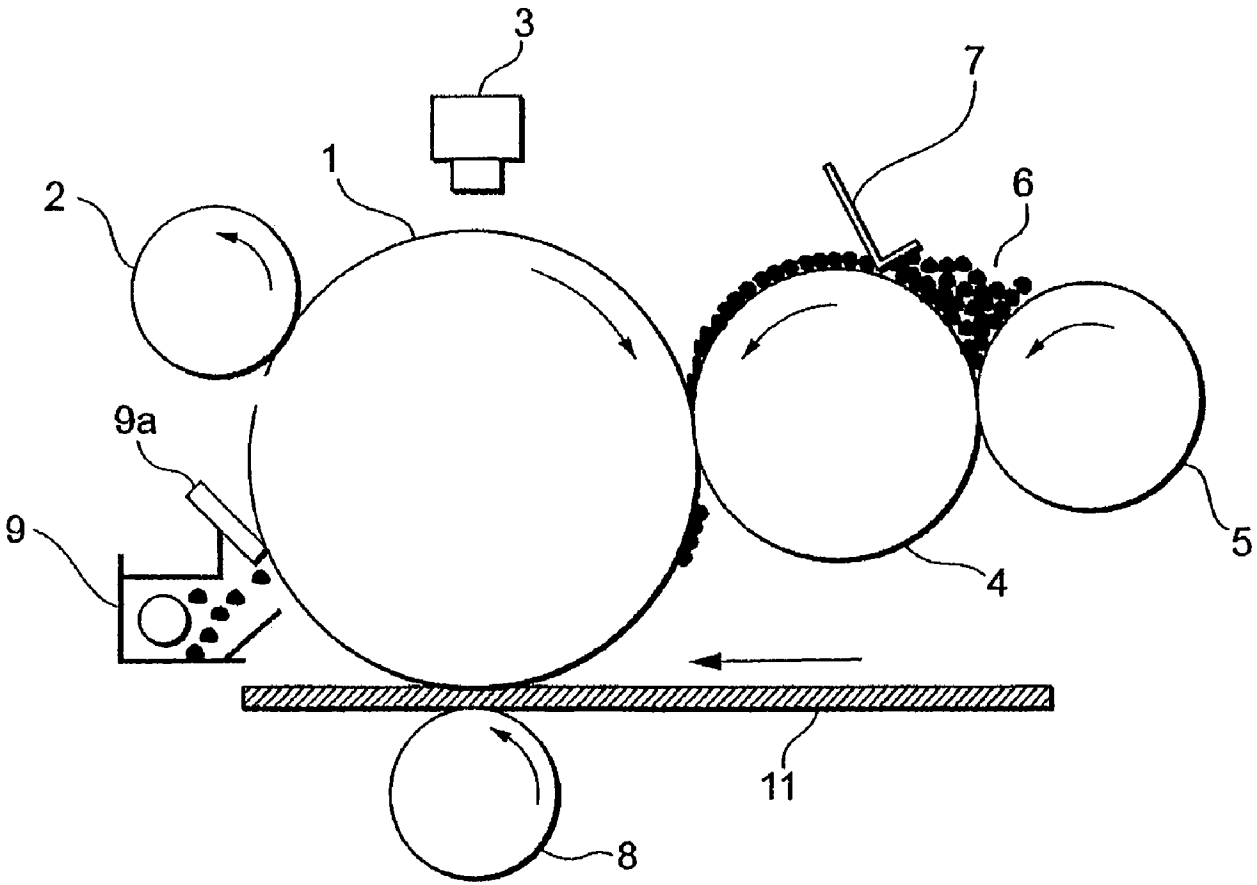
FIG. 1 is a constructional diagram of a mechanism system in each of the first to fifth embodiments.

An image forming apparatus of the invention comprises: an electrostatic latent image holder (i.e. an electrostatic latent image-bearing body); an image forming member provided for the electrostatic latent image holder in a contact state; setting means (as a setting section) for setting a set value for rotating the electrostatic latent image holder by a predetermined amount before an electrostatic latent image is formed onto the electrostatic latent image holder; and a control unit for rotating the electrostatic latent image holder on the basis of the set value before the electrostatic latent image is formed onto the electrostatic latent image holder.

Embodiments according to the invention will be described hereinbelow with reference to the drawings. Common component elements in the drawings are designated by the same reference numerals.

[Embodiment 1]

According to an image forming apparatus of the first embodiment, the number of idle rotating times of a drum can be set by the operator and a photosensitive drum is idle-rotated by the timing before printing on the basis of the set value.

(Construction)

As shown in FIG. 1, the image forming apparatus of the first embodiment comprises: a photosensitive drum 1 serving as an electrostatic latent image holder; a charging roller 2 for charging the photosensitive drum 1 to a predetermined electric potential; an exposing unit 3 for forming an electrostatic latent image onto the photosensitive drum 1; a developing roller 4 made of semiconductive rubber or the like; a toner supplying roller 5 for conveying toner 6; a developing blade 7 for forming a thin layer of the toner 6 onto the developing roller 4; a transfer roller 8 for transferring a toner image which was electrostatically deposited onto the electrostatic latent image on the photosensitive drum 1 onto a print medium 11; and a cleaning unit 9 for removing the toner 6 remaining on the photosensitive drum 1 after the transfer.

Each of the charging roller 2, the developing roller 4, the toner supplying roller 5, and the like generally has a structure in which semiconductive rubber such as epichlorohydrine rubber or the like is molded like a roll onto a conductive metal shaft and the rubber surface is modified or a protective layer is formed on the surface.

The above component elements are arranged as illustrated in the diagram and rotated in the directions shown by arrows in the diagram on the basis of control of the control unit, which will be explained hereinafter.

Figure 2:
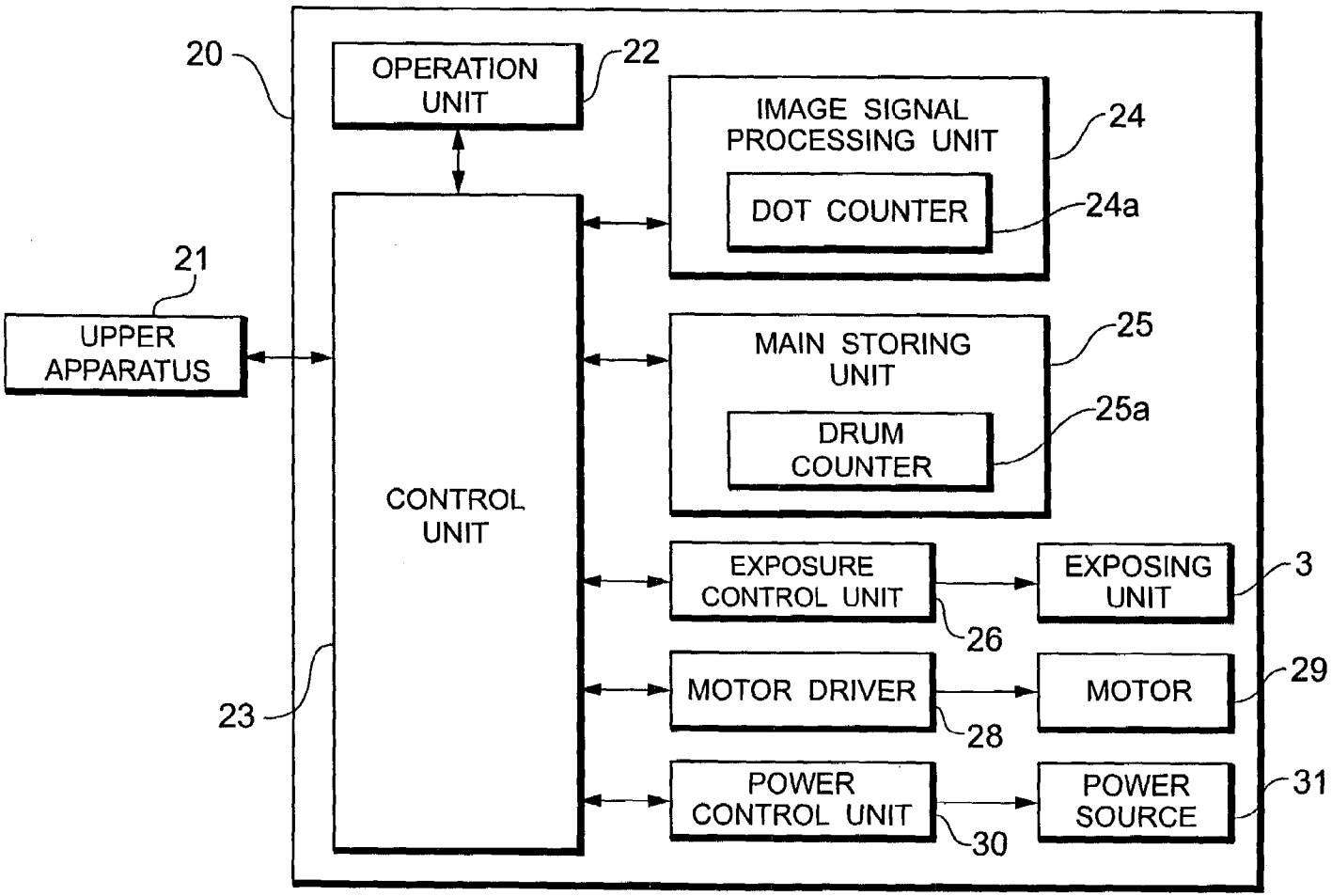
FIG. 2 is a constructional diagram of a control system in each of the first to fourth embodiments.

FIG. 2 is a block diagram of the image forming apparatus of the first embodiment. As shown in the diagram, an image forming apparatus 20 of the first embodiment comprises: a control unit 23 for receiving print data or the like from an upper apparatus 21 such as a PC (personal computer) or the like and making print control; an operation unit 22 for executing various setting operations of the image forming apparatus; an image signal processing unit 24 which has a dot counter 24*a* therein and forms a print image; a main storing unit 25 constructed by a ROM for storing a control program, a drum counter 25*a* for storing the number of rotating times of the photosensitive drum, and another working memory; an exposure control unit 26 for controlling the exposing unit 3 in accordance with the print image; a motor driver 28 for controlling a motor 29 of the image forming apparatus; and a power control unit 30 for controlling a power source 31 to apply a bias voltage to each unit. Those component elements are connected as shown in the diagram.

The dot counter 24*a* is provided in the image signal processing unit 24 and counts the number of dots when the image is formed. However, the counting method is not limited to such an example but the dot counter 24*a* can be also constructed in such a manner that it is not provided in the image signal processing unit 24 but, upon printing, the number of dots is counted in the control unit 23 and a count result is stored into the main storing unit 25.

(Operation)

By the above construction, the image forming apparatus of the first embodiment operates as follows. First, the operation for idle-rotating the drum by the timing before printing (hereinafter, such an operation is referred to as "drum idle rotation") and the printing operation will now be described with reference to a time chart of FIG. 3.

The drum idle rotating operation denotes the operation in which before the printing operation is started, that is, before the electrostatic latent image is formed onto the photosensitive drum 1, predetermined voltages are applied to the charging roller 2, developing roller 4, toner supplying roller 5, and transfer roller 8, thereby rotating the photosensitive drum 1.

Figure 3:
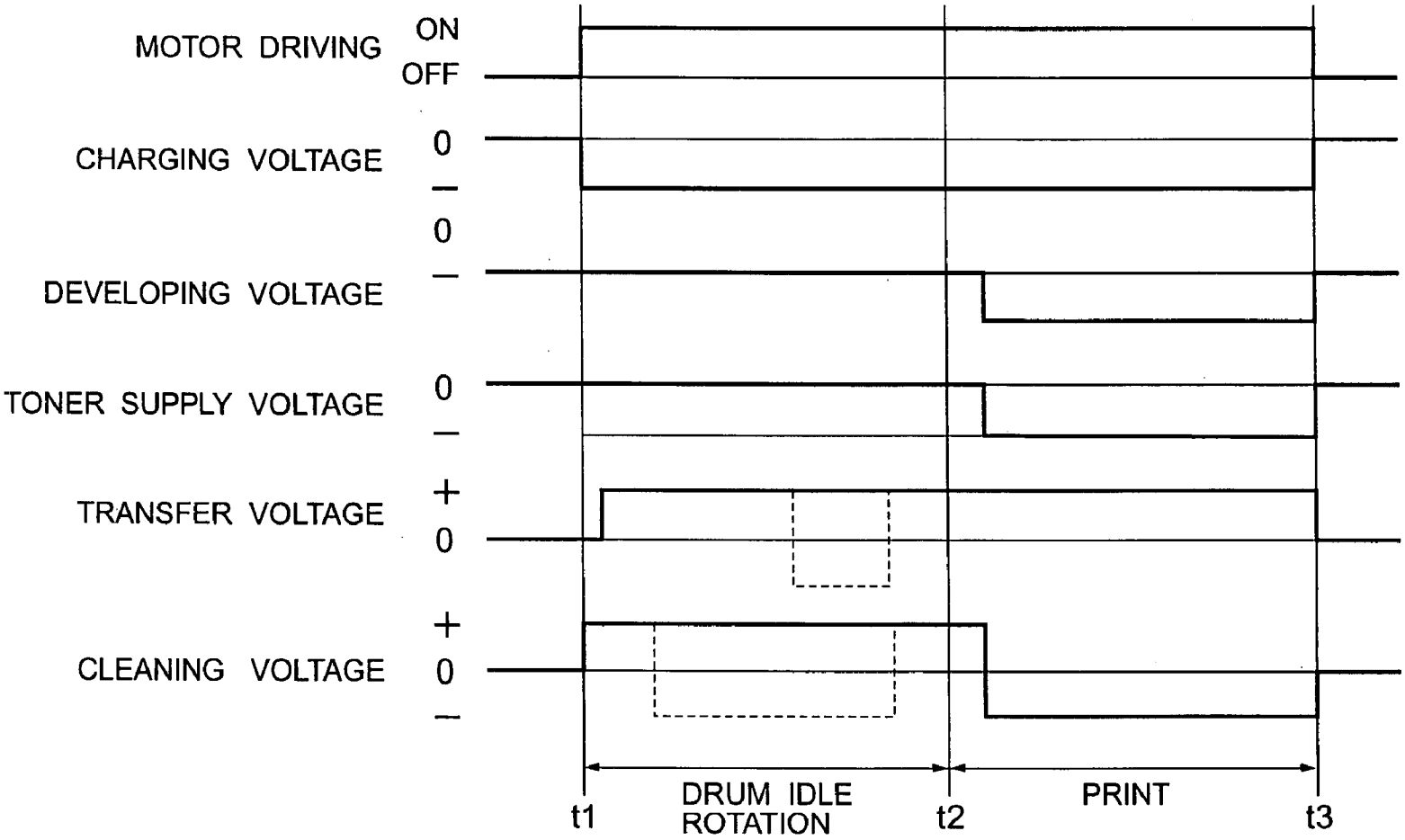
FIG. 3 is a time chart for the first to fifth embodiments.

In FIG. 3, a motor drive signal is a signal showing ON/OFF of the rotation of the photosensitive drum 1. A charge voltage signal, a development voltage signal, a toner supply voltage signal, and a transfer voltage signal show voltages which are applied to the charging roller 2, developing roller 4, toner supplying roller 5, and transfer roller 8, respectively. In each of those signals, "0" denotes that the applied voltage is equal to an electric potential of 0V, "−" denotes that a predetermined minus electric potential is applied, and "+" shows that a predetermined plus voltage is applied, respectively.

First, as an idle rotating operation of the drum, the electric potential of each of the charging roller 2, developing roller 4, toner supplying roller 5, transfer roller 8, and cleaning unit 9 is applied at timing t1 as shown in the time chart, the photosensitive drum 1 is rotated so that the toner 6 is not conveyed to the photosensitive drum 1, and the drum idle rotating operation is finished at timing t2.

The electric potential which is applied to each unit is switched as shown in the time chart, the printing operation to print the print data or the like from the upper apparatus 21 is started, and the printing operation is finished at timing t3.

In the above explanation, a cleaning blade 9*a* is pressed onto the photosensitive drum 1 and the oligomer components deposited on the surface of the photosensitive drum are removed by friction. In the case of using a cleaning roller in place of the cleaning blade 9*a*, in the drum idle rotating operation for an interval between timing t1 and timing t2, as shown by a broken line, it is also possible that the "–" voltage is applied to the cleaning unit 9 and the transfer roller 8 for a predetermined time and the toner 6 deposited on the charging roller, the transfer roller, and the like is removed and collected into the cleaning unit 9 as a warming-up operation.

Figure 4:
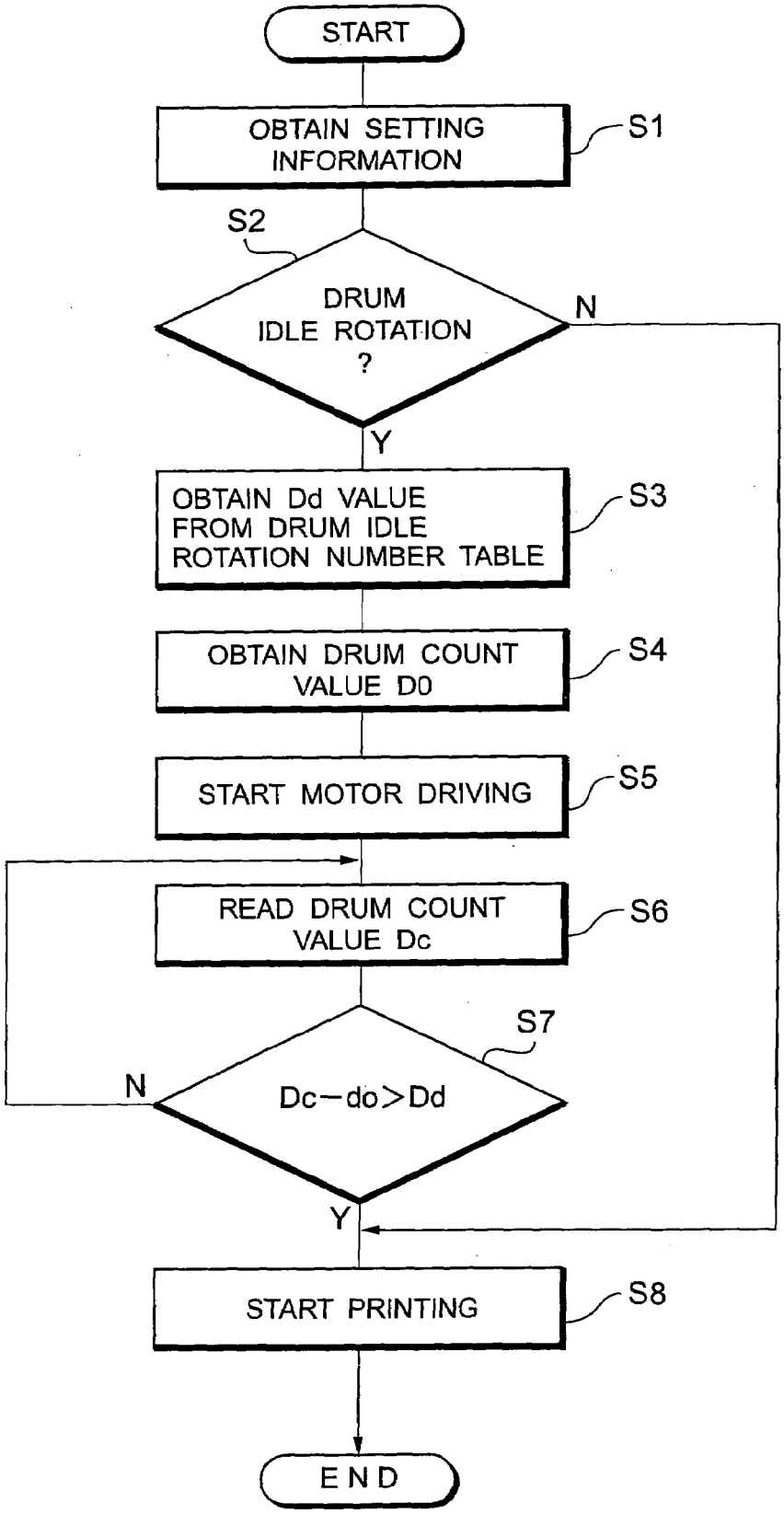
FIG. 4 is a flowchart for the operation in the first embodiment.

The operation of the drum idle rotation control will now be described with reference to an operation flowchart of FIG. 4. First, the various set values set by the operator are obtained by the upper apparatus 21 or the operation unit 22 (step S1).

The set values of the upper apparatus 21 are ordinarily set by using a property setup of the printing apparatus 20. The set values of the image forming apparatus 20 are set by using the operation unit 22 of the image forming apparatus 20.

Upon setting regarding the drum idle rotation, it is preferable that the number of idle rotating times of the drum is predetermined every setting mode as shown in FIG. 5, which will be explained hereinafter, and the operator selects a desired setting mode. For example, in the case where the drum idle rotation is not executed, level 0 is selected. In the case where although the drum idle rotation is executed, it is sufficient to set print quality to be relatively low, level 1 is selected. In the case where the operator wants to perform the printing of high quality even if the idle rotating operation before the start of the printing is long, level 3 is selected. In the intermediate case between them, level 2 is selected.

Returning to FIG. 4, the quality setting information is extracted from the information obtained in step S1 and whether or not the drum idle rotation is executed is discriminated (step S2). If level 0 is set and the drum idle rotating operation is not executed, the processing routine advances to step S8 without executing the drum idle rotation and the printing is started.

If one of levels 1 to 3 is set and the drum idle rotation is executed in step S2, a value of the number (Dd) of drum idle rotating times according to the set level is obtained with reference to a table of the number (Dd) of drum idle rotating times (hereinafter, referred to as a drum idle rotation number (Dd) table) shown in FIG. 5. For example, if level 3 as a setting in which the operator wants to perform the printing of the high quality although it takes a time due to the drum idle rotation, the number of drum idle rotating times (Dd=10 times) is obtained (step S3). A drum count value D0 is obtained from the drum counter 25*a* (step S4). The driving of the motor 29 is started. The photosensitive drum 1 and the like are rotated (step S5, timing t1). A drum count value Dc which changes by one rotation of the photosensitive drum 1 is read out (step S6). The drum idle rotation is executed until it is detected that the photosensitive drum 1 has been rotated the number (Dd) of drum idle rotating times (step S7).

When it is detected that the photosensitive drum 1 has been rotated the number (Dd) of drum idle rotating times, the printing operation is started (step S8, timing t2).

By idle-rotating the photosensitive drum the number (Dd) of drum idle rotating times according to the level which has been preset by the operator or the like before the printing as described above, the oligomer components deposited on the surface of the photosensitive drum in the nip portion can be physically removed by the cleaning blade 9*a* of the cleaning unit 9 or can be further efficiently removed by applying the voltage to the cleaning unit 9.

Although the setting of the voltage of each unit is not described for simplicity of explanation in the above description of the operation, it is sufficient to switch the voltages at timing t1, t2, and t3 as shown in the time chart of FIG. 3.

Although the first embodiment has been described above on the assumption that the operator performs only the setting regarding the number of drum idle rotating times, it is also possible to construct in such a manner that the operator can freely set the timing for executing the drum idle rotation to, for example, timing just before the printing is started, timing after the elapse of a predetermined time of the idle state, or the like.

(Effects of the First Embodiment)

According to the first embodiment mentioned above, since the apparatus is controlled so as to execute the drum idle rotation by the timing before the printing in accordance with the setting of the operator, the printing of the quality desired by the operator can be executed.

[Embodiment 2]

According to an image forming apparatus of the second embodiment, the number of drum idle rotating times is changed in accordance with a kind of print image.

(Construction)

According to a construction of the second embodiment, the number (Dd) of drum idle rotating times according to the kind of print image is stored in the drum idle rotation number (Dd) table stored in the main storing unit 25. Since other constructions are similar to those in the first embodiment shown in FIGS. 1 and 2, their detailed explanation is omitted for simplicity of explanation.

First, the construction of the drum idle rotation number (Dd) table in the second embodiment will be described hereinbelow. Generally, a text, graphics, desk top publishing (hereinafter, abbreviated to "DTP"), a photograph, and the like can be given as kinds of print images. According to an experiment for comparing degrees of generation of the oligomer lines which are caused after the drum was rested for a predetermined time after it had been rotated, for example, 3000 times, in the case of printing an image of high picture quality such as DTP or photograph, or the like, the oligomer line is generated more typically. This is because the higher the print quality is, the higher the print density is and the oligomer line is generated even by a small amount of oligomer components. On the basis of such characteristics, the number of drum idle rotating times is set to be larger for the DTP or photograph as shown in FIG. 6.

Naturally, since the degree of generation of the oligomer line changes depending on a material, a shape, or the like of the photosensitive drum 1 or the like and an amount of residual toner on the drum which can be cleaned by the drum idle rotation also changes depending on a material, a shape, an applied voltage, or the like of the cleaning unit 9 or the like, it is desirable to experimentally obtain the optimum number (Dd) of drum idle rotating times every model type and use it as a set value.

(Operation)

Figure 7:
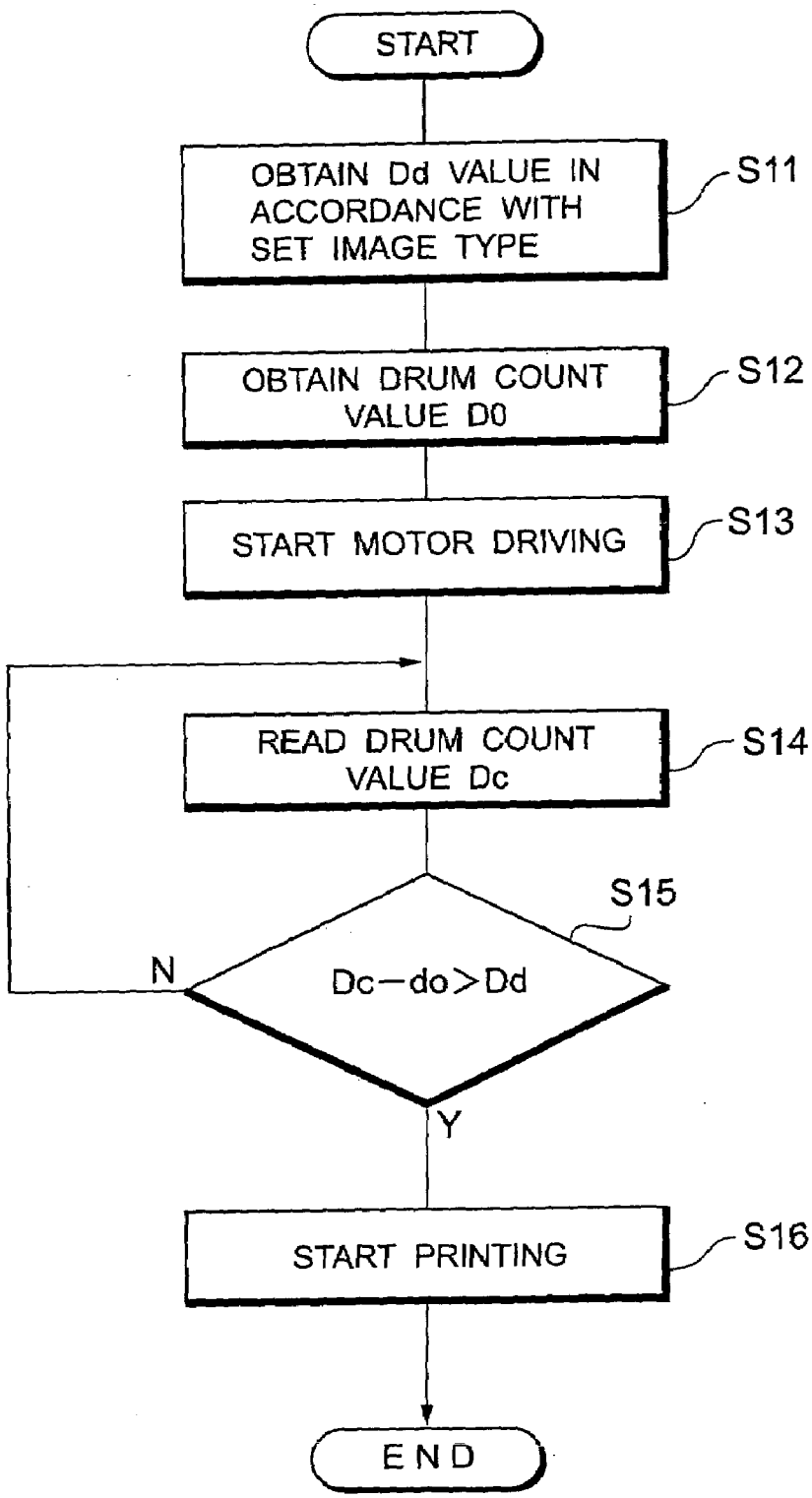
FIG. 7 is a flowchart for the operation in the second embodiment.

The image forming apparatus of the second embodiment operates as follows by the above construction. The operation will be described in detail with reference to an operation flowchart of FIG. 7. Since processes of steps S12 to S16 in the operation of the image forming apparatus are similar to those of steps S4 to S8 in the first embodiment described in FIG. 4, their detailed description is omitted for simplicity of explanation. Since switching timing of the voltage of each unit is similar to that in the time chart shown in FIG. 3, their detailed description is omitted for simplicity of explanation.

First, the various set values set by the operator are obtained by the upper apparatus 21 or the operation unit 22 (step S11). The various set values are set by the property setup of the printing apparatus of the upper apparatus 21 or by using the operation unit 22 of the image forming apparatus 20 in a manner similar to the first embodiment.

The information of the print image kind is extracted from the information obtained in step S11 and the number (Dd) of drum idle rotating times according to the print image kind is obtained with reference to the drum idle rotation number (Dd) table shown in FIG. 6. For example, if the DTP is selected as a print image kind and the printing is executed, the number of drum idle rotating times (Dd=6 times) is obtained.

Subsequently, in steps S12 to S15, after the drum count value D0 is obtained from the drum counter 25*a*, the driving of the motor 29 is started (timing t1). The drum count value Dc is read out while rotating the photosensitive drum 1 and the like. The drum idle rotation is executed until it is detected that the photosensitive drum 1 has been rotated the number (Dd) of drum idle rotating times.

When it is detected that the photosensitive drum 1 has been rotated the number (Dd) of drum idle rotating times, the printing operation is started (step S16, timing t2).

By idle-rotating the photosensitive drum by the timing before the printing on the basis of the number of drum idle rotating times according to the print image kind which has been preset by the operator or the like as described above, the oligomer components deposited on the surface of the photosensitive drum in the nip portion can be removed by the cleaning unit 9.

(Effects of the Second Embodiment)

According to the second embodiment mentioned above, since the number of drum idle rotating times is changed in accordance with the print image kind, the proper drum idle rotation can be executed in accordance with the degree of generation of the oligomer line which changes depending on the print image kind and the print quality can be improved.

[Embodiment 3]

According to an image forming apparatus of the third embodiment, the number of drum idle rotating times is changed in accordance with a rotation amount of the drum in consideration of characteristics in which the degree of generation of the oligomer line changes depending on the drum rotation amount.

(Construction)

According to a construction of the third embodiment, the number (Dd) of drum idle rotating times according to the drum count value is stored in the drum idle rotation number (Dd) table stored in the main storing unit 25. Since other constructions are similar to those in the first embodiment shown in FIGS. 1 and 2, their detailed explanation is omitted for simplicity of explanation.

Figures 8, 9:
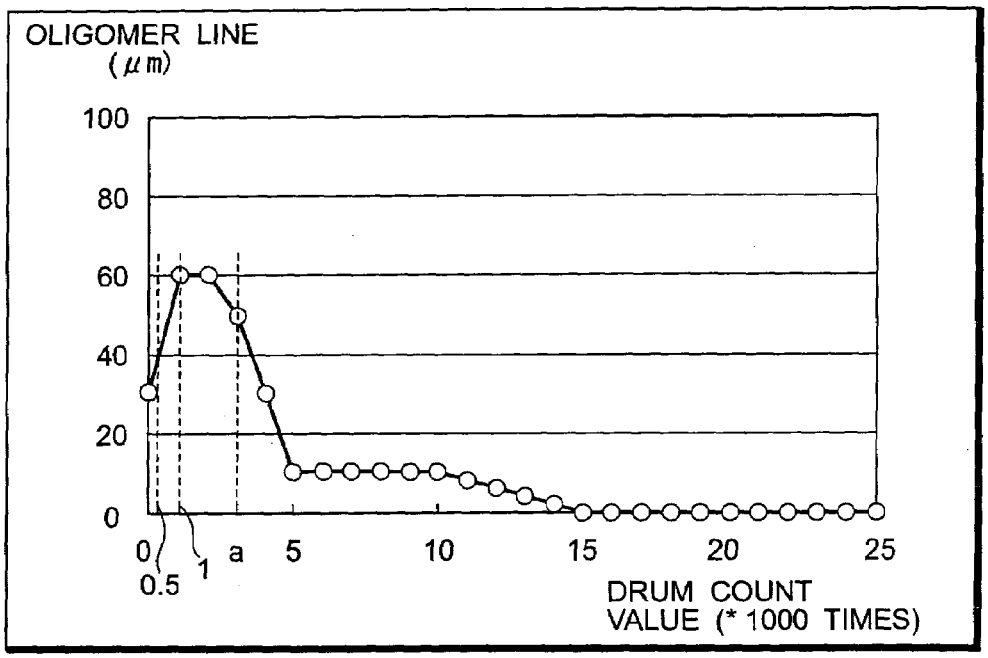
FIG. 8 is a diagram for explaining a relation between a drum count value and the generation of an oligomer line.
FIG. 9 is a table of the number (Dd) of idle rotating times of a drum in the third embodiment.

The construction of the drum idle rotation number (Dd) table in the third embodiment will be described hereinbelow. First, FIG. 8 is a graph showing a relation between the drum count value and the generation of the oligomer line in the case where the printing without print data was repeated is experimentally obtained. In the graph, an axis of abscissa denotes the drum count value corresponding to the accumulated number of drum rotating times. A plurality of apparatuses are used, the drum is rested for a predetermined time every rotation of 1000 times of the drum, thereafter, halftone printing is executed, widths of oligomer lines are optically measured, and an average of them is calculated. An axis of ordinate shows the obtained average of the oligomer line widths.

As shown in the graph, it will be understood that when the drum count value is equal to 500 to 3000 times, the oligomer lines are most typically generated. Therefore, it is desirable to increase the number of drum idle rotating times in the case where the number of drum rotating times is equal to about 500 to 3000 times. According to those characteristics, as shown in a drum idle rotation number Dd table in FIG. 9, the drum idle rotation according to the drum count value is set in such a manner that the number (Dd) of drum idle rotating times is set to 6 times until the number of drum rotating times is equal to 0 to 500 times, Dd=12 times until the number of drum rotating times is equal to 501 to 3000 times, Dd=6 times until the number of drum rotating times is equal to 3001 to 10000 times, and the like.

Naturally, since the degree of generation of the oligomer line changes depending on the material, shape, or the like of the photosensitive drum 1 or the like and the amount of residual toner on the drum which can be cleaned by the drum idle rotation also changes depending on the material, shape, applied voltage, or the like of the cleaning unit 9 or the like, it is desirable to experimentally obtain the optimum number (Dd) of drum idle rotating times every model type and use it as a set value. Although the example in which the number (Dd) of drum idle rotating times is divided and set as shown in FIG. 9 has been shown, it can be divided more finely and set, or contrarily, it can be coarsely divided and set.

(Operation)

Figure 10:
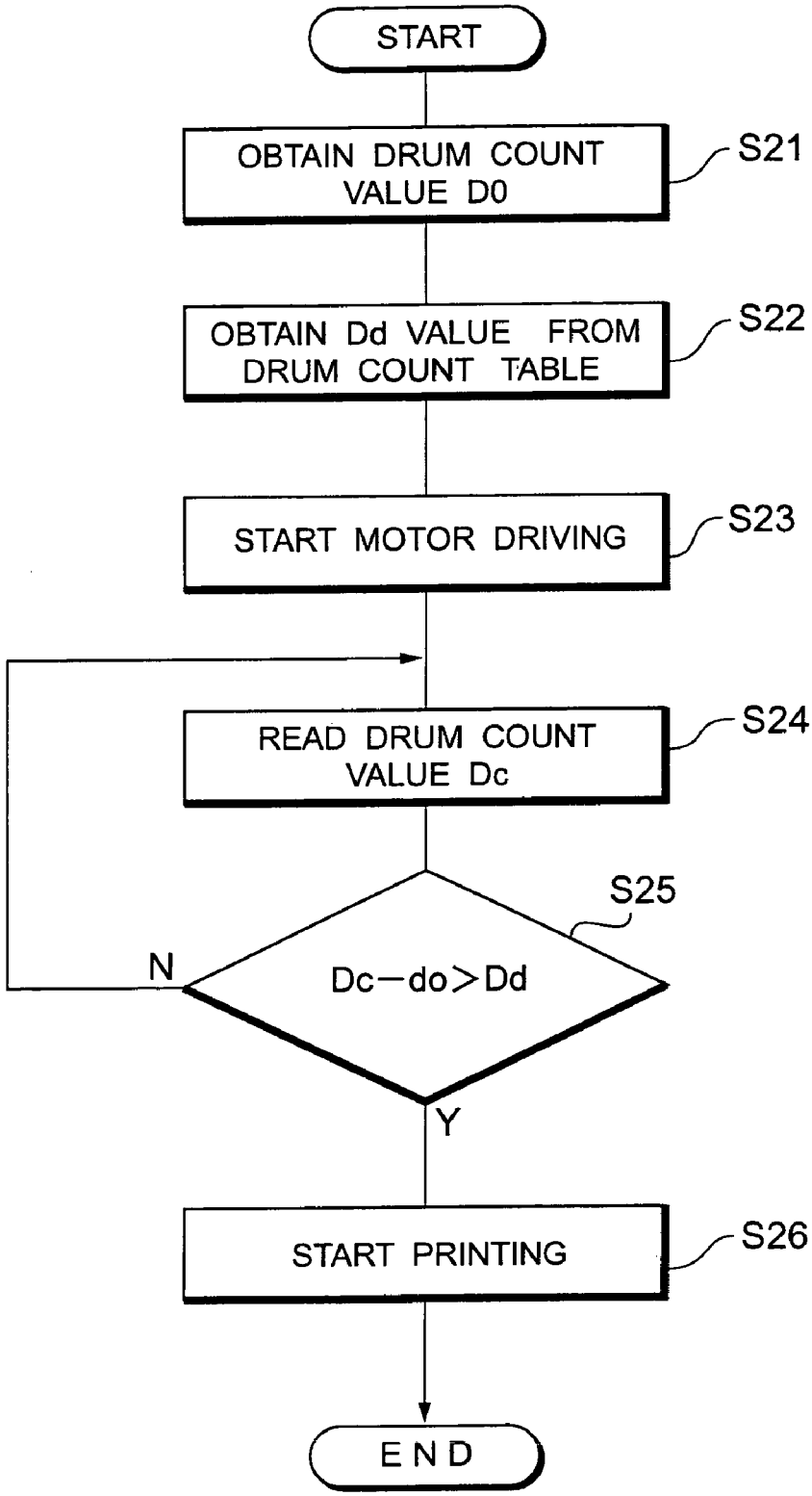
FIG. 10 is a flowchart for the operation in the third embodiment.

The image forming apparatus of the third embodiment operates as follows by the above construction. The operation will be described in detail with reference to an operation flowchart of FIG. 10. Since processes of steps S23 to S26 in the operation of the image forming apparatus are similar to those of steps S5 to S8 in the first embodiment described in FIG. 4, their detailed description is omitted for simplicity of explanation. Since switching timing of the voltage of each unit is similar to that in the time chart shown in FIG. 3, their detailed description is omitted for simplicity of explanation.

First, the drum count value D0 is obtained by the drum counter 25*a* (step S21). Subsequently, the number (Dd) of drum idle rotating times corresponding to the obtained drum count value D0 is obtained (step S22) with reference to the drum idle rotation number (Dd) table described in FIG. 9. For example, if the drum count value D0 obtained in step S21 is equal to 2500 times, the value of 12 times is obtained as the number (Dd) of drum idle rotating times with reference to the drum idle rotation number (Dd) table described in FIG. 9.

Subsequently, in steps S23 to S25, the driving of the motor 29 is started (timing t1), the drum count value Dc is read out while rotating the photosensitive drum 1 and the like, and the drum idle rotation is executed until it is detected that the photosensitive drum 1 has been rotated the number (Dd) of drum idle rotating times which was obtained.

When it is detected that the photosensitive drum 1 has been rotated the number (Dd) of drum idle rotating times, the printing operation is started (step S26, timing t2).

By idle-rotating the photosensitive drum the optimum number (Dd) of drum idle rotating times according to the drum count value corresponding to the accumulated number of drum rotating times by the timing before the printing as mentioned above, the oligomer components can be efficiently removed by the cleaning unit 9.

(Effects of the Third Embodiment)

According to the third embodiment mentioned above, since the number of drum idle rotating times is changed in accordance with the drum count value, the proper drum idle rotation can be executed in accordance with the degree of generation of the oligomer line which fluctuates depending on the drum count value and the print quality can be improved.

[Embodiment 4]

According to an image forming apparatus of the fourth embodiment, the number of drum idle rotating times is changed in accordance with a print density in consideration of characteristics in which the degree of generation of the oligomer line changes depending on the print density.

(Construction)

Figures 11, 12:
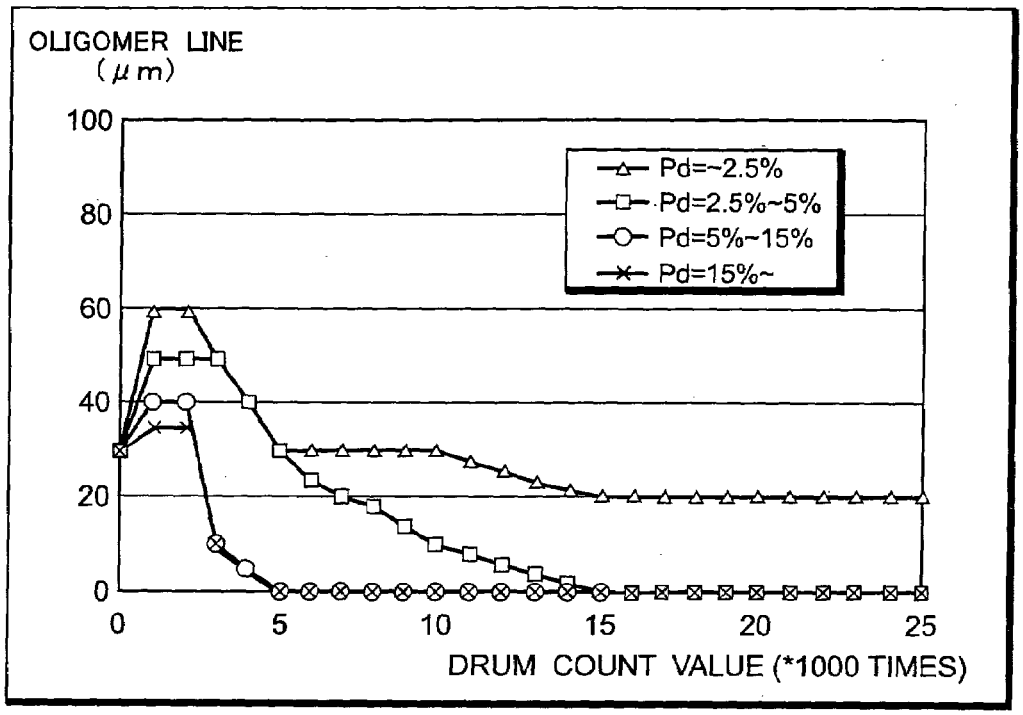
FIG. 11 is a diagram for explaining a relation between a print density Pd and the generation of the oligomer line.
FIG. 12 is a correction table according to a print density in the fourth embodiment.

According to a construction of the fourth embodiment, a correction value ΔDd of the number of drum idle rotating times according to an average print density so far is stored as shown in FIG. 12. Since other constructions are similar to those in the first embodiment shown in FIGS. 1 and 2, their detailed description is omitted for simplicity of explanation. First, the construction of a correction table of the number of drum idle rotating times (hereinafter, referred to as a drum idle rotation number correction table) according to the print density in the fourth embodiment will be described hereinbelow. FIG. 11 is a graph showing a relation between the drum count value and the generation of the oligomer line which is experimentally obtained every print density. An axis of abscissa denotes the drum count value corresponding to the accumulated number of drum rotating times. The printing operation is repeated at a predetermined print density by a plurality of apparatuses, the drum is rested for a predetermined time every rotation of 1000 times of the drum, thereafter, the halftone printing is executed, widths of oligomer lines are optically measured, and an average of them is calculated. An axis of ordinate shows the obtained average of the oligomer line widths.

A print density Pd in the graph is calculated by the following equation (1) on the basis of the drum count value D0 and Dt obtained by accumulating and counting the number of print dots by the dot counter 24*a* in the image signal processing unit 24 and the print density Pd is shown by a percentage.

$$Pd=Dt/(D0*\text{the number of dots of the whole drum surface}) \quad (1)$$

From FIG. 11, it will be understood that although the degree of generation of the oligomer lines is the highest and there is a variation in the case where the number of drum idle rotating times is equal to 500 to 3000 times in a manner similar to a tendency shown in FIG. 8, the lower the print density Pd is, the higher the degree of generation of the oligomer lines is.

From the above characteristics, the correction value ΔDd is set, as shown in FIG. 12, as a correction of the number (Dd) of drum idle rotating times by the print density Pd.

Naturally, since the degree of generation of the oligomer line due to the print density Pd changes depending on the material, shape, or the like of the photosensitive drum 1 or the like and the amount of residual toner on the drum which can be cleaned by the drum idle rotation also changes depending on the material, shape, applied voltage, or the like of the cleaning unit 9 or the like, it is desirable to obtain the optimum correction amount ΔDd every model type and use it as a set value. Although the example in which the print density is divided and set as shown in FIG. 12 has been shown, it can be divided more finely and set, or contrarily, it can be coarsely divided and set.

(Operation)

Figure 13:
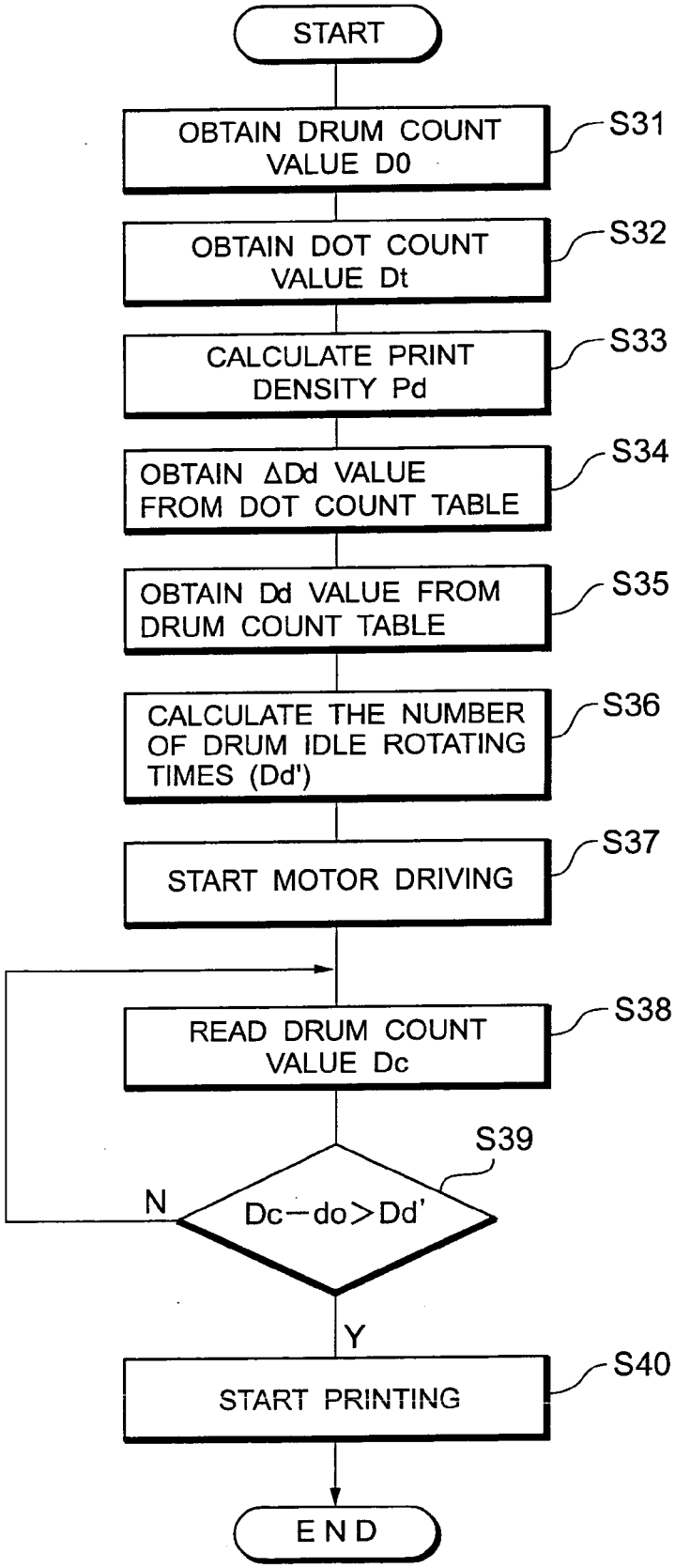
FIG. 13 is a flowchart for the operation in the fourth embodiment.

The image forming apparatus of the fourth embodiment operates as follows by the above construction. The operation will be described in detail with reference to an operation flowchart of FIG. 13. Since processes of steps S37 to S40 in the operation of the image forming apparatus are similar to those of steps S5 to S8 in the first embodiment described in FIG. 4, their detailed description is omitted for simplicity of explanation. Since switching timing of the voltage of each unit is similar to that in the time chart shown in FIG. 3, their detailed description is omitted for simplicity of explanation.

First, the drum count value D0 is obtained by the drum counter 25*a* (step S31). The dot count value Dt is obtained from the dot counter 24*a* (step S32). The print density Pd is calculated by the equation (1) (step S33). The correction value ΔDd of the number of drum idle rotating times corresponding to the calculated print density Pd is extracted. For example, if the printing is executed at a relatively low print density, in the case of Pd=4%, "2" is extracted as a correction value ΔDd from the correction table of FIG. 12.

Subsequently, the number (Dd) of drum idle rotating times corresponding to the drum count value D0 obtained in step S31 is obtained with reference to the drum idle rotation number (Dd) table in FIG. 9 (step S35). For example, if the drum count value D0 obtained in step S31 is equal to 2500 times, the value of 12 times is obtained as the number (Dd) of drum idle rotating times with reference to the drum idle rotation number (Dd) table in FIG. 9. In the example of the correction value ΔDd based on the print density obtained in step S34, that is, Pd=4%, it is added to "2" and the number (Dd') of drum idle rotating times is calculated by the following equation (2), thereby obtaining Dd'=14 (step S36).

$$Dd'=Dd+\Delta Dd \quad (2)$$

Subsequently, in steps S37 to S39, the driving of the motor 29 is started (timing t1). The drum count value Dc is read out while rotating the photosensitive drum 1 and the like. The drum idle rotation is executed until it is detected that the photosensitive drum 1 has been rotated the obtained number (Dd') of drum idle rotating times. When it is detected that the photosensitive drum 1 has been rotated the number (Dd') of drum idle rotating times, the printing operation is started (step S40, timing t2).

As a construction of the correction table according to the print density as shown in FIG. 12 as described above, the invention is not limited to the method whereby ΔDd is obtained in step S34 and the number (Dd) of drum idle rotating times is obtained by the drum count number D0 and they are added, but it is also possible to use a construction in which and the number (Dd) of drum idle rotating times to the print density Pd is preset every drum count value as shown in FIG. 14 in consideration of an influence by the print density Pd and the number (Dd) of drum idle rotating times is directly extracted from the drum count number D0 and the print density Pd.

(Effects of the Fourth Embodiment)

According to the fourth embodiment mentioned above, since the number of drum idle rotating times is corrected on the basis of the print density, the proper drum idle rotation can be executed in accordance with the degree of generation of the oligomer line which fluctuates depending on the print density by the timing for printing and the print quality can be efficiently improved.

[Embodiment 5]

According to an image forming apparatus of the fifth embodiment, the number of drum idle rotating times is changed in accordance with an apparatus environment in consideration of characteristics in which the degree of generation of the oligomer line changes depending on the apparatus environment such as temperature, humidity, and the like.

(Construction)

Figure 15:
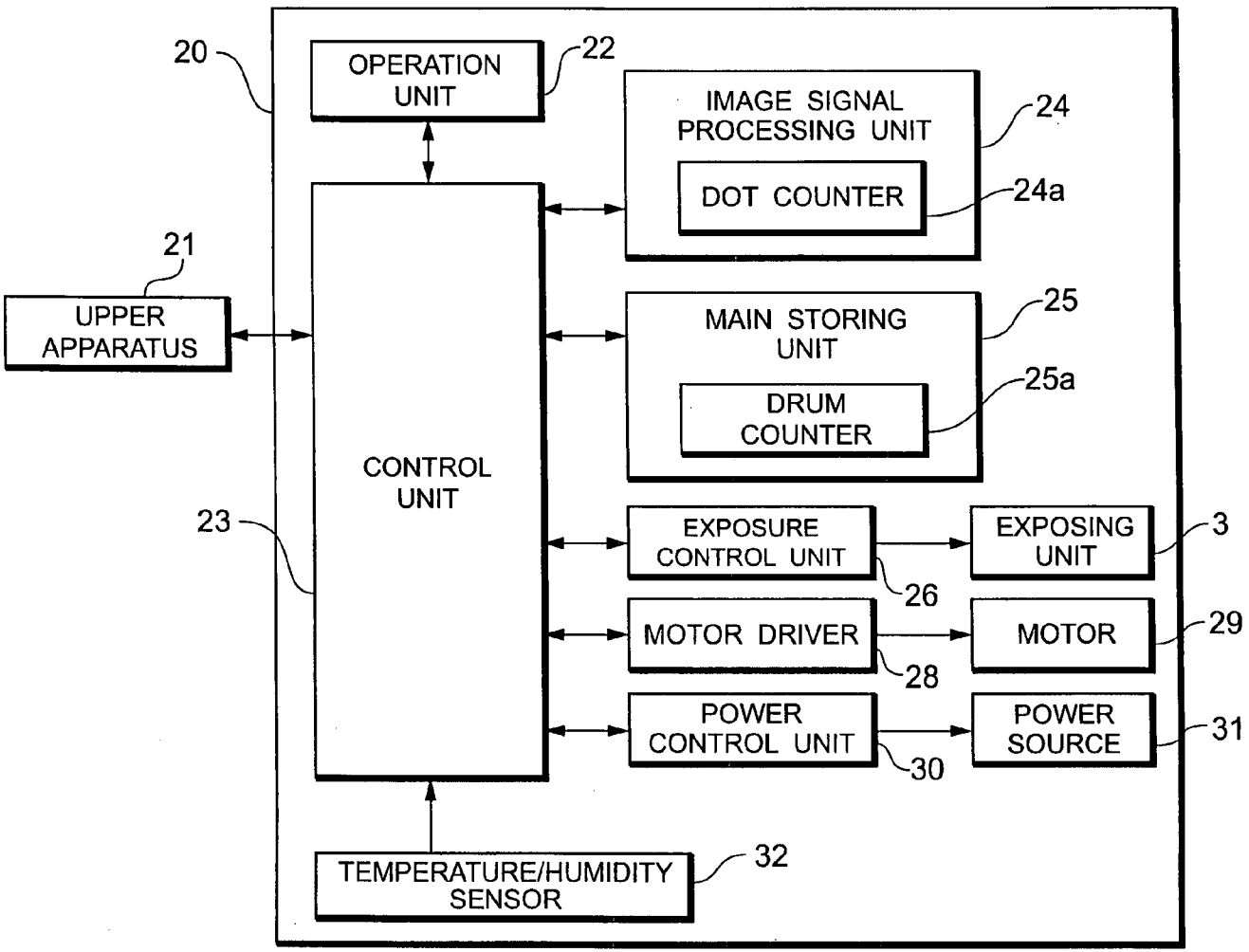
FIG. 15 is a constructional diagram of a control system in the fifth embodiment.

According to a construction of the fifth embodiment, a temperature/humidity sensor 32 is connected as an environment sensor to the control unit as shown in FIG. 15 and the correction value ΔDd' of the number of drum idle rotating times corresponding to absolute humidity which is obtained from the temperature and humidity as shown in FIG. 16 is stored. Since other constructions are similar to those in the first embodiment shown in FIGS. 1 and 2, their detailed explanation is omitted for simplicity of explanation.

First, the construction of a correction table of the number (Dd) of drum idle rotating times according to the environment in the fifth embodiment shown in FIG. 16 will be described. The absolute humidity denotes the absolute humidity ($g/m^3$) which is obtained from the temperature and relative humidity in the apparatus which are detected by the temperature/humidity sensor 32. Since it has experimentally been obtained that the higher the absolute humidity is, the higher the degree of generation of the oligomer line is, the correction value ΔDd' of the number (Dd) of drum idle rotating times is set every predetermined absolute humidity range from those characteristics as shown in FIG. 16.

Naturally, since the degree of generation of the oligomer line due to the absolute humidity changes depending on the material, shape, or the like of the photosensitive drum 1 or the like and an amount of residual toner on the drum which can be cleaned by the drum idle rotation also changes depending on the material, shape, applied voltage, or the like of the cleaning unit 9 or the like, it is desirable to experimentally obtain the optimum correction value ΔDd' every model type and use it as a set value. Although the example in which the absolute humidity is divided and set as shown in FIG. 16 has been shown, it can be divided more finely and set, or contrarily, it can be coarsely divided and set.

(Operation)

Figure 17:
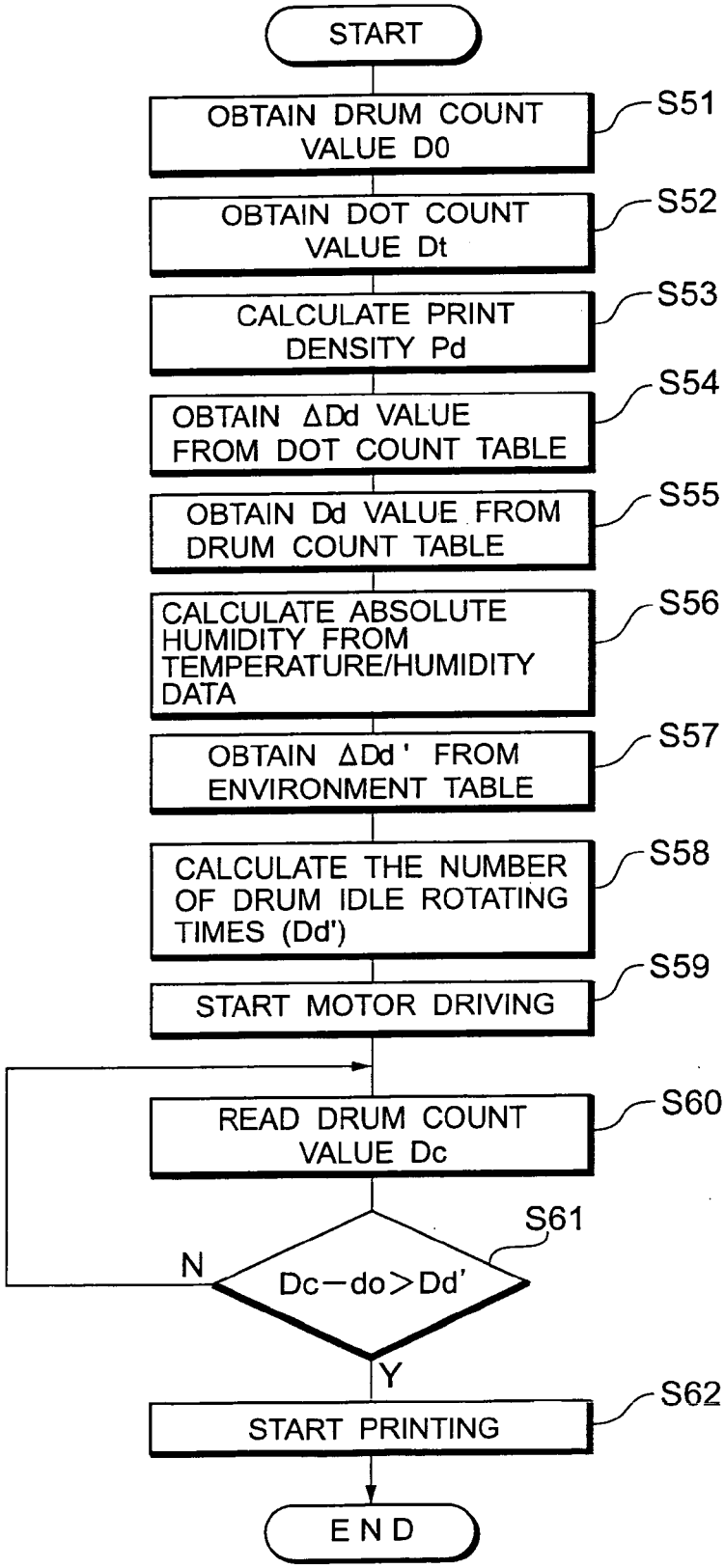
FIG. 17 is a flowchart for the operation in the fifth embodiment.

The image forming apparatus of the fifth embodiment operates as follows by the above construction. The operation will be described in detail with reference to an operation flowchart of FIG. 17. Since processes of steps S51 to S55 and steps S59 to S62 in the operation of the image forming apparatus are similar to those of steps S31 to S35 and steps S37 to S40 in the fourth embodiment described in FIG. 13, their detailed description is omitted for simplicity of explanation. Since switching timing of the voltage of each unit is similar to that in the time chart shown in FIG. 3, their detailed description is omitted for simplicity of explanation.

First, in steps S51 to S55, the drum count value D0 is obtained by the drum counter 25*a*, the dot count value Dt is obtained from the dot counter 24*a*, the print density Pd is calculated by the equation (1), and the correction value ΔDd of the number of drum idle rotating times corresponding to the calculated print density Pd is extracted. The number (Dd) of drum idle rotating times corresponding to the drum count value D0 is obtained with reference to the drum idle rotation number (Dd) table described in FIG. 9.

Subsequently, the absolute humidity is calculated on the basis of the detection result of the temperature/humidity sensor and a correction value ΔDd' corresponding to the calculated absolute humidity is extracted from the correction table according to the environment in FIG. 16. For example, when the absolute humidity is equal to 10 ($g/m^3$), the correction value ΔDd' =1 is obtained from the correction table according to the environment in FIG. 16.

The number (Dd') of drum idle rotating times is calculated by the following equation (3) on the basis of the correction value ΔDd' obtained as mentioned above (step S58).

$$Dd'=Dd+\Delta Dd \tag{3}$$

Subsequently, in steps S59 to S61, the driving of the motor 29 is started (timing t1). The drum count value Dc is read out while rotating the photosensitive drum 1 and the like. The drum idle rotation is executed until it is detected that the photosensitive drum 1 has been rotated the number (Dd') of drum idle rotating times. When it is detected that the photosensitive drum 1 has been rotated the number (Dd') of drum idle rotating times, the printing operation is started (step S62, timing t2).

The invention is not limited to the construction of the correction table according to the environment as shown in FIG. 16 but it is also possible to use a construction in which the number (Dd) of drum idle rotating times to the drum count value and the print density Pd as shown in FIG. 14 is set, it is further provided every absolute humidity, and the number (Dd) of drum idle rotating times is directly extracted from the drum count value D0, the print density Pd, and the absolute humidity.

(Effects of the Fifth Embodiment)

According to the fifth embodiment mentioned above, since the number of drum idle rotating times can be corrected in accordance with the apparatus environment, the photosensitive drum 1 can be properly idle-rotated by the timing before the printing in accordance with the degree of generation of the oligomer line which fluctuates depending on the apparatus environment and the print quality can be efficiently improved.

<<Other Modifications>>

Besides the foregoing embodiments, functions and effects similar to those of the invention can be also obtained by the following modifications. That is, (1) Although the above embodiments have been described with respect to the example in which the number of drum idle rotating times is set by the operation unit 22 in the image forming apparatus 20 and the example in which it is set from the drum count value, the dot count value, or the like, it is also possible to use a construction in which the information of the print image kind, print density, drum count value, dot count value, and the like is managed by the upper apparatus and the number of drum idle rotating times is determined on the basis of those information and transmitted as an idle rotation command to the image forming apparatus.

(2) Although the above embodiments have been described with respect to the example in which the number of drum idle rotating times is set by the operator or the example in which it is set in accordance with the drum count value, dot count value, and the like, it is also possible to use a slightly expensive construction in which the oligomer components on the photosensitive drum 1 are detected by an optical sensor or the like and the number of drum idle rotating times is set on the basis of a detection result of the optical sensor.

(3) Although the above embodiments have been described with respect to the example in which the drum idle rotation is performed on the basis of the set values by the timing before the printing as shown in the time chart of FIG. 3, it is also possible to use a construction in which when the apparatus is in a stationary state for a predetermined period after the printing operation, the drum idle rotation is executed only once or at every predetermined time.

(4) Although the priority setting of the number of drum idle rotating times which has been set by the upper apparatus or the operation unit and the priority setting of the number of drum idle rotating times which is automatically extracted from the drum count value and the like by the control unit 23 are not particularly mentioned in the explanation of the above embodiments, it is also possible to use a construction in which the priorities are preset by the upper apparatus or the operation unit 22 or a table of the priorities is provided in the upper apparatus or the image forming apparatus and the number of drum idle rotating times is set in accordance with the priorities.

(5) Although the fourth and fifth embodiments have been described with respect to the example in which the number of drum idle rotating times according to the drum count value is corrected on the basis of the print density or the environment, in an image forming apparatus in which the degree of generation of the oligomer line is not largely changed by the drum count value, it is also possible to use a construction in which the number of drum idle rotating times is independently set irrespective of the drum count value and the drum idle rotation before the printing is executed on the basis of the set number of drum idle rotating times.

(6) Although the setting of the number of drum idle rotating times according to the time of the stationary state is not mentioned in the explanation of the above embodiments, it is also possible to use a construction in which a time during which the printing operation is not executed in a power-ON state, which a time during which the power source is turned off by a timer or the like which is backed up by a battery, or the like is measured and the set number of drum idle rotating times is corrected in accordance with the measured time.

As mentioned above, the present invention can be widely applied not only to the image forming apparatuses such as an electrophotographic printer and the like but also to an image forming apparatus in which the oligomer components are generated in the portion where a roller of each section of a copying apparatus or the like is come into contact.

The present invention is not limited to the foregoing embodiments but many modifications and variations are possible within the spirit and scope of the appended claims of the invention.

What is claimed is:

1. An image forming apparatus for forming an image by executing a printing operation, the image forming apparatus comprising:

an electrostatic latent image-bearing body having an extraneous substance deposited on a surface thereof;

a developing member supplying a developer on the electrostatic latent image-bearing body;

a control unit for rotating said electrostatic latent image-bearing body by one or more predetermined number of times before performing the printing operation in which an electrostatic latent image is formed onto the electrostatic latent image-bearing body and the developing member supplies the developer to the electrostatic latent image; and a removing member contacting with the electrostatic latent image-bearing body so that the removing member removes the extraneous substance from the surface of the electrostatic latent image-bearing body while said electrostatic latent image-bearing body is rotated by the predetermined number of times.

2. The image forming apparatus according to claim 1, further comprising a voltage providing section for providing said developing member with a voltage, wherein, until said electrostatic latent image-bearing body is rotated by the predetermined number of times, said voltage providing section controls said voltage provided to said developing member.

3. The image forming apparatus according to claim 1, further comprising:

an electrifying member for electrifying said electrostatic latent image-bearing body;

a transferring member for transferring said developer on said electrostatic latent image-bearing body onto a printing medium; and a voltage providing section which provides respectively said electrifying member, said developing member and said transferring member with voltages, wherein, until said electrostatic latent image-bearing body is rotated by the predetermined number of times, said voltage providing section controls said voltages provided to said electrifying member, said developing member and said transferring member.

4. The image forming apparatus according to claim 3, wherein the transferring member is a transfer roller.

5. The image forming apparatus according to claim 3, wherein the electrifying member is a charging roller.

6. The image forming apparatus according to claim 1, wherein the predetermined number is set on the basis of a kind of a print image.

7. The image forming apparatus according to claim 6, wherein, when the print image is a kind having a higher print density the predetermined number is set bigger.

8. The image forming apparatus according to claim 1, wherein the predetermined number is set on the basis of an accumulated rotation number of said electrostatic latent image-bearing body before performing the printing operation.

9. The image forming apparatus according to claim 8, wherein, when the extraneous substance is deposited more at the accumulated rotation number of said electrostatic latent image-bearing body before performing the printing operation, said predetermined number is set bigger.

10. The image forming apparatus according to claim 1, wherein the predetermined number is set on the basis of a print density of a printing image.

11. The image forming apparatus according to claim 10, wherein, when the print density of said printing images is lower, said predetermined number is set bigger.

12. The image forming apparatus according to claim 1, further comprising a detecting unit which obtains temperature/humidity information, wherein the predetermined number is set on the basis of a detection result of said detecting unit.

13. The image forming apparatus according to claim 12, wherein, when an absolute humidity which is calculated on the basis of the result of said detecting unit is higher, said predetermined number is set bigger.

14. The image forming apparatus according to claim 1, further comprising a cleaning member for collecting the extraneous substance after the extraneous substance is removed from the electrostatic latent image-bearing body.

15. The image forming apparatus according to claim 1, wherein the removing member is a blade.

16. The image forming apparatus according to claim 1, wherein the removing member is a cleaning roller.

17. The image forming apparatus according to claim 1, wherein the extraneous substance is an oligomer.

18. The image forming apparatus according to claim 1, wherein the extraneous substance is a toner.

19. The image forming apparatus according to claim 1, wherein the electrostatic latent image-bearing body is completely rotated by said one or more predetermined number of times before performing the printing operation.

* * * * *